US010122482B1

(12) United States Patent
Jacob et al.

(10) Patent No.: US 10,122,482 B1
(45) Date of Patent: Nov. 6, 2018

(54) RADIO RECEIVER SYSTEM

(71) Applicant: NXP B.V., Eindhoven (NL)

(72) Inventors: Naveen Jacob, Bangalore (IN); Rajesh Kurian, Bangalore (IN)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/677,169

(22) Filed: Aug. 15, 2017

(51) Int. Cl.
*H04H 20/93* (2008.01)
*H04H 40/27* (2008.01)
*H04H 60/27* (2008.01)

(52) U.S. Cl.
CPC ..... *H04H 20/93* (2013.01); *H04H 40/27* (2013.01); *H04H 60/27* (2013.01)

(58) Field of Classification Search
CPC ..... H04H 20/93; H04H 40/27; H04H 60/27
See application file for complete search history.

(56) References Cited

U.S. PATENT DOCUMENTS 8,335,872 B2 12/2012 Pahuja et al.
9,065,577 B2 6/2015 Griffin et al.
2006/0193408 A1* 8/2006 Elliott ..... H04B 17/309 375/343
2009/0141817 A1* 6/2009 Walker ..... H04L 27/04 375/260
2016/0088549 A1* 3/2016 Dominic ..... H04W 48/16 455/515
2017/0257657 A1* 9/2017 Christensen ..... H04H 60/37
2017/0366361 A1* 12/2017 Afkhami ..... H04L 12/10

FOREIGN PATENT DOCUMENTS

JP 2007088923 * 4/2007

* cited by examiner

*Primary Examiner* — Nguyen T Vo
(74) *Attorney, Agent, or Firm* — Rajeev Madnawat

(57) ABSTRACT

A radio receiver is disclosed. The radio receiver includes an analog tuner and a baseband processor to provide radio functions. The baseband processor is coupled to the analog tuner. The radio receiver further includes a memory and a controller coupled to the analog tuner, the baseband processor and the memory. The controller is configured to perform an operation and the operation includes causing the analog tuner to scan a spectral band to identify radio stations and based on a signal matrix obtained from scanning a station in the spectral band tentatively determining if the station represents a digital radio mondiale (DRM) station and if so, storing the station in a list of possible DRM stations in the memory.

18 Claims, 2 Drawing Sheets

RADIO RECEIVER SYSTEM

BACKGROUND

Digital Radio Mondiale (DRM) is a set of digital audio broadcasting technologies designed to work over the frequency bands currently used for analog radio broadcasting including Amplitude Modulation (AM) broadcasting, particularly shortwave, and Frequency Modulation (FM) broadcasting. DRM is more spectrally efficient than AM and FM, allowing more stations, at higher quality, into a given amount of bandwidth, using various MPEG-4 audio coding formats.

Modern radio receiver systems typically include a visual display to display information to users. This information may include list of stations in different categories such as AM stations, FM stations and DRM stations. Program information associated with each program being broadcasted may also be included in the display.

Typically, the broadcast stations are scanned separately to obtain a list of different types of stations in a geographical area and the list must be updated in the case when a radio receiver system is mounted in a moving vehicle.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, a radio receiver is disclosed. The radio receiver includes an analog tuner and a baseband processor to provide radio functions. The baseband processor is coupled to the analog tuner. The radio receiver further includes a memory and a controller coupled to the analog tuner, the baseband processor and the memory. The controller is configured to perform an operation and the operation includes causing the analog tuner to scan a spectral band to identify radio stations and based on a signal matrix obtained from scanning a station in the spectral band tentatively determining if the station represents a digital radio mondiale (DRM) station and if so, storing the station in a list of possible DRM stations in the memory.

The analog tuner may be an amplitude modulation (AM) tuner a frequency modulation (FM) tuner.

In some embodiments, when the AM tuner is being used, the tentatively determining includes measuring if a carrier frequency offset is greater than 2 KHz, measuring if a dominant frequency is greater than 5 KHz and also determining may include measuring if a high modulation index is unsettled.

When the FM tuner is being used, the tentatively determining may include measuring if a level detector result is an unsettled value, measuring if a noise detector result is an unsettled arbitrary value, measuring if a multipath detector result is an unsettled value and measuring if a radio frequency offset is an arbitrary value.

The list of possible DRM stations includes DRM stations and band pass noise identified as tentative DRM stations and the controller is further configured to scan stations in the list of possible DRM stations to remove stations that represent band pass noise.

The controller is further configured to identify AM or FM stations during the scanning for tentative DRM stations.

In another embodiment, a method for tentatively identifying digital radio mondiale (DRM) stations in a spectral band using an analog tuner is disclosed. The method comprises scanning a station in a spectral band using the analog tuner and determining if the station represents an amplitude modulation (AM) station or a frequency modulation (FM) station and if not, based on a signal matrix obtained from the station in the spectral band tentatively determining if the station represents a digital radio mondiale (DRM) station and if so, storing the station in a list of possible DRM stations in a memory. The analog tuner may be an amplitude modulation (AM) tuner or a frequency modulation (FM) tuner. The tentatively determining may include measuring if a carrier frequency offset is greater than 2 KHz, measuring if a dominant frequency is greater than 5 KHz and measuring if a high modulation index is unsettled. In case of the FM tuner the tentatively determining may include measuring if a level detector result is an unsettled value.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Advantages of the subject matter claimed will become apparent to those skilled in the art upon reading this description in conjunction with the accompanying drawings, in which like reference numerals have been used to designate like elements, and in which:

Note that figures are not drawn to scale. Intermediate steps between figure transitions have been omitted so as not to obfuscate the disclosure. Those intermediate steps are known to a person skilled in the art.

DETAILED DESCRIPTION

Many well-known manufacturing steps, components, and connectors have been omitted or not described in details in the description so as not to obfuscate the present disclosure.

In a radio receiver, broadcast bands are scanned frequently to identify AM, FM and DRM stations. In a modern radio receiver, the information obtained through the identification process is displayed on a user interface or display for a user. Identification of DRM stations is a relatively time consuming process when the entire broadcast spectrum needs to be scanned for the identification of DRM stations.

The embodiments disclosed herein make use of a two step process in which analog AM and FM tuners are used for making a list of possible DRM stations during the identification of AM and FM stations. In the second step, the DRM station identification process is then performed on this short list of possible DRM stations, thereby making the overall station identification process faster. Typically, it takes approximately 300 ms to determine if a particular station is a DRM station. A spectral band may contain 100+ stations, therefore it may take upto 30+ seconds to scan the entire spectral band to make a list of DRM stations. The embodiments described herein uses an analog tuner to identify an AM station or a FM station that takes approximately 30 ms per station. If a particular station is either AM or FM station, it cannot be a DRM station. This pre-exclusion of stations that are not DRM stations limits the DRM station identification routine to run on a limited number of stations, thus making the overall process faster.

Figure 1:
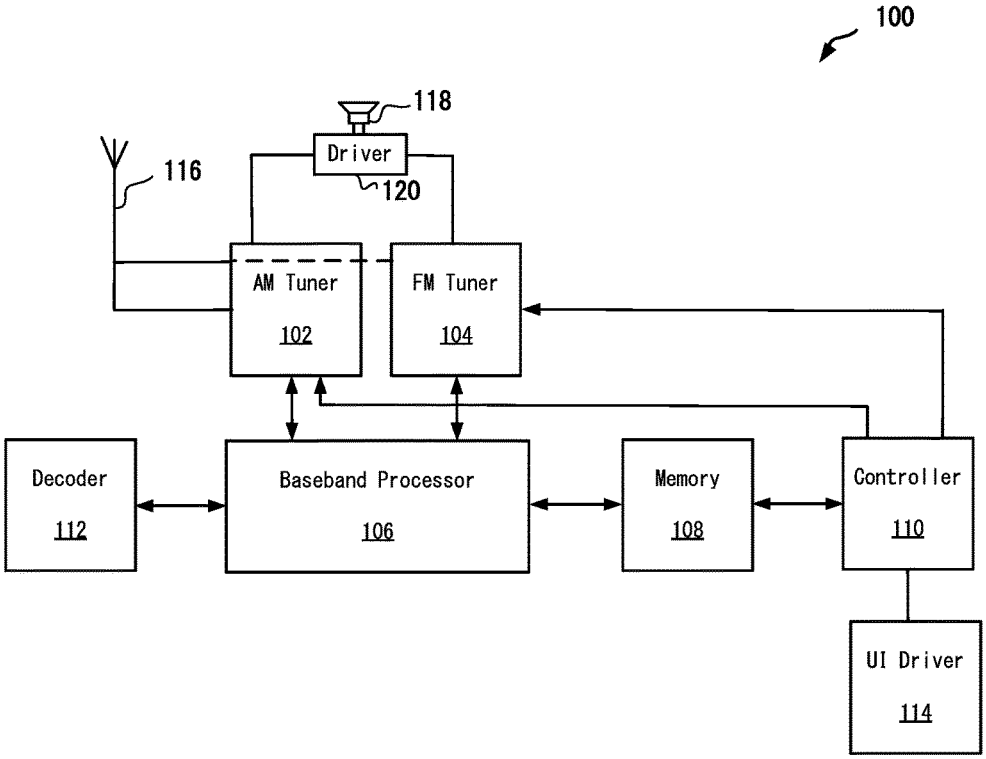
FIG. 1 shows a block diagram of a radio receiver in accordance with one or more embodiments.

FIG. 1 shows a simple block diagram of an improved radio receiver 100. As shown, the radio receiver 100 includes an AM tuner 102, a FM tuner 104, a baseband processor 106, a memory 108 and a controller 110. The radio receiver 100 may also include a decoder 112 for decoding received digital transmission. The baseband processor 106 manages radio functions such as signal modulation/demodulation, encoding, radio frequency shifting, etc. The baseband processor 106 may include its own memory and an internal processor and can be built in a separate chip or may also be fabricated on a same chip as the controller 110. The baseband processor 106 may include a real-time operating system stored in its own memory and to be executed by the internal processor of the baseband processor 106.

The AM tuner 102 and the FM tuner 104 are coupled to an antenna 116 and a speaker 118 via an audio driver 120. These tuners are used to receive AM/FM signals and based on a user selection of a station, one of these tuners can receive programming from the selected station and play the programming on the speaker 118. The radio receiver 100 may include a user interface (UI) driver 114 to provide display signals to a user interface of the radio receiver 100. The audio driver 120 may convert signals received from the AM/FM tuners through driving a coil of the speaker 118, thus to convert electrical signals into sound waves.

In one example, the controller 100 performs overall coordination for playing a radio station by sending tune commands to the AM/FM tuners, and validating responses from the tuners to determine if the tuning is operational. The controller 110 may request the baseband processor 106 to send periodic notifications on signal quality and associated parameters. In some embodiments, the decoded radio signal is forwarded by the baseband processor 106 to the controller 110 for source decoding and for the final presentation of the decoded data (that may includes, audio data and program information data including pictures and videos) to the speaker 118 or to the user interface.

Figure 2:
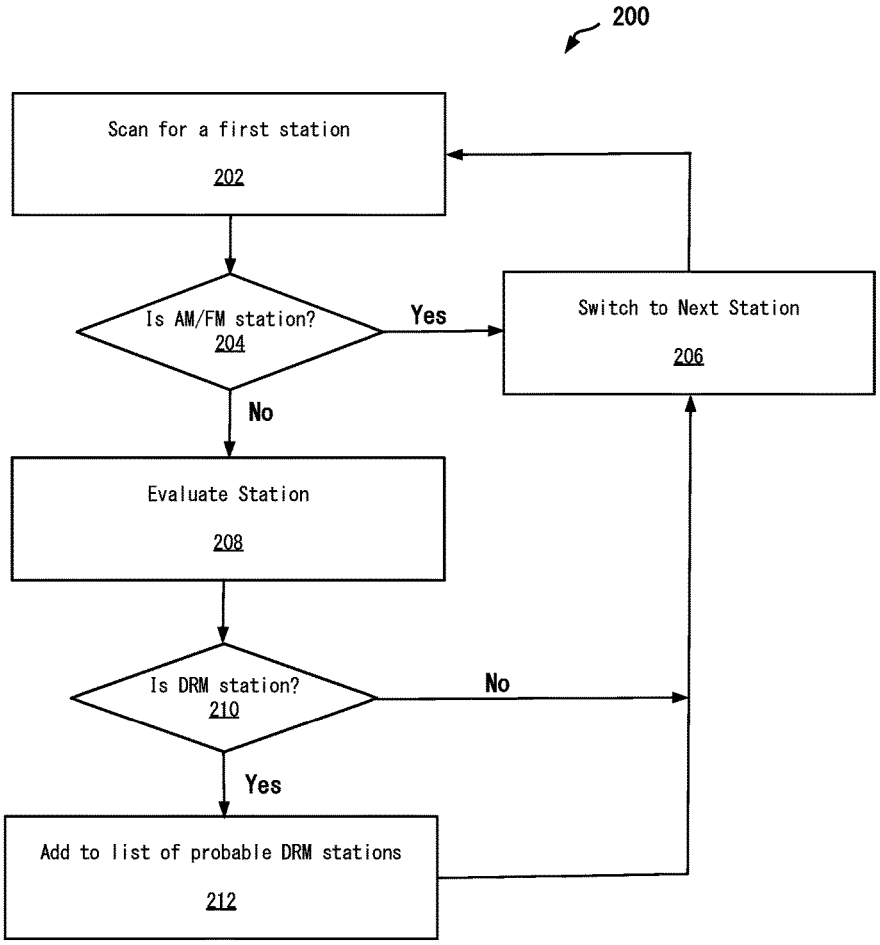
FIG. 2 shows a method of identifying DRM stations in accordance with one or more embodiments.

FIG. 2 shows a method 200 for identifying possible DRM stations. Accordingly, at step 202, the AM tuner 102 is used to scan the first station in the broadcast band, starting at the one of end of the frequency spectrum of the spectral band. At decision step 204, the baseband processor 106 or the controller 110 with the assistance of the baseband processor 106, determines if the scanned station is an AM station. During the scan, the AM tuner 102 look for strong signal energy because a weak or no signal strength for a particular scanned frequency would mean that that frequency is not being used for a transmission or the transmission is unusable to be played on the radio receiver 100.

The same process of scanning may be employed for AM and FM bands. FM band scanning is performed using the FM tuner 104 instead of the AM tuner 102. The AM band scanning results in obtaining one or more of the following parameters from the scanned station: Modulation index, carrier frequency offset, dominant frequency, energy of the station, occupied bandwidth and adjacent channel power. The FM scan may result in obtaining one or more of the following parameters: Level detector result: noise detector result, multipath or cochannel detector result, radio frequency offset, IF (Intermediate frequency) bandwidth and modulation metric (say modulation index).

In one example, the station or frequency being scanned is an AM station if the carrier frequency offset is less than 2 kHz, dominant frequency is less than 5 kHz and high modulation index is settle at approximately 30%.

Similarly, in one example, when FM band scanning is being performed by the FM tuner 104, the scanned band or frequency may indicate a FM station if level detector result is a settled constant value, ultrasonic noise level is a settled arbitrary value, multipath or cochannel detector result has a settled value and radio frequency offset is less than 2 kHz.

If the scanned frequency is either an AM or a FM station then at step 206, a next frequency is switched to and the process of scanning is repeated. Is should be noted that even though AM and FM scanning is depicted in the same flow chart, in practice, AM and FM scanning can be done independently and isolated from each other. Since the basic flowchart is the same, scanning for both AM and FM is being described together to avoid repetition of the description.

At step 208, the station is evaluated to tentatively identify if the station could be a DRM station. In some example, the process of step 208 may be incorporated in step 204. At decision step 210, if the station is not found to be a DRM station then the control goes to step 206. If the station is preliminarily found to be a DRM station then at step 212, the station is stored in a list of possible DRM stations in the memory 108.

In the case of AM scanning, if one or more of these parameters are found to have values as follows, the station may possibly be a DRM station. Carrier frequency offset is greater than 2 kHz, dominant frequency is greater than 5 kHz and high modulation index is any value and not settled.

In case of FM scanning, if one or more of these parameters are found to have values as follows, the station may possibly be a DRM station. Level detector result is an unsettled value, ultrasonic noise level is an unsettled arbitrary value, multipath or cochannel detector result is an unsettled value and radio frequency offset is an arbitrary value.

In other words, if the tuners detect high signal energy and receive unsettled values of parameters, the scanned station may possibly be a DRM station but not necessarily. The possible DRM station list may include some stations that are not DRM stations. The AM or FM tuner may encounter a "band pass noise" and "DRM station" other than the AM/FM stations. When the tuner encounters a band pass noise or a DRM station, both are marked as probable DRM stations. In the second pass, the list of possible DRM stations is scanned and DRM stations are identified using traditional DRM station identification process. However and as stated above, since list of possible DRM stations is shorter than the full list of available channels in the spectral band, the overall process of identifying DRM stations will be significantly quicker.

DRM uses COFDM (Coded Orthogonal Frequency Division Multiplexing) with QAM (Quadrature Amplitude Modulation). DRM is commonly seen with 10 kHz of bandwidth but other bandwidth between 4.5 KHz to 20 KHz are also used. Removing "band pass noise" stations in the list of possible DRM station may involve attempting to decode the signal. Only a real DRM station will have signals that contains encoded data.

It should be noted that even though the embodiments are being described for DRM, a person skilled in the art would appreciate that the embodiments described herein may also be used for tentatively detecting other types of Orthogonal frequency-division multiplexing (OFDM) transmission in AM/FM frequency bands. For example, the embodiments may also be used to tentatively detect wireless LAN (WLAN) radio interfaces IEEE 802.11a, g, n, ac and HIPERLAN/2, digital radio systems DAB/EUREKA 147, DAB+, HD Radio, T-DMB and ISDB-TSB, terrestrial digital TV systems DVB-T and ISDB-T, terrestrial mobile TV systems DVB-H, T-DMB, ISDB-T and MediaFLO forward link, wireless personal area network (PAN) ultra-wideband (UWB) IEEE 802.15.3a, 4G and pre-4G cellular networks and mobile broadband standards, mobility mode of the wireless MAN/broadband wireless access (BWA) standard IEEE 802.16e (or Mobile-WiMAX) and mobile broadband wireless access (MBWA) standard IEEE 802.20.

Similar mechanism can be used to tentatively identifying DRM+ stations, which is populated with FM stations as DRM+ is allocated in the FM spectral band. The FM spectrum will also look frequency flat with no strong carrier unlike the AM transmission. Similar to what is described above, to make a tentative list of DRM+ stations, as a first step, a FM scan is done on the band for which DRM+ scan must be carried out. It is noted that the list of parameters per FM station will be of a particular range or invalid type for DRM+ station. In the second step, a DRM+ scan for the shortlist generated in the first step can be performed. The scanning time per station will be as usual for a typical DRM+ station. However, this scan needs to be done only on a subset of the full set of DRM+ stations. The FM scan provides the following metrics for each FM station: level detector result, noise detector result, multipath or cochannel detector result, radio frequency offset, IF (Intermediate frequency) bandwidth, and Modulation index. Of these parameters, some parameters will show erroneous/invalid values when the station under question is a DRM+ station or if the scanning hits a strong band pass noise. In case of a valid FM station, these parameters will be settled and defined values, hence FM stations can be distinguished from possible DRM+ stations In some embodiments, the FM scan may be performed for the second time, to determine if the parameters returned are consistent with the first-time scan. For a possible DRM+ station, the parameters of two FM station scans will not be in agreement—and can be used as an indicator of the presence of DRM+ station.

Some or all of these embodiments may be combined, some may be omitted altogether, and additional process steps can be added while still achieving the products described herein. Thus, the subject matter described herein can be embodied in many different variations, and all such variations are contemplated to be within the scope of what is claimed.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. A radio receiver, comprising:

an analog tuner;

a baseband processor to provide radio functions, wherein the baseband processor is coupled to the analog tuner;

a memory; and a controller coupled to the analog tuner, the baseband processor and the memory, wherein the controller is configured to perform an operation, the operation includes causing the analog tuner to scan a spectral band to identify radio stations and based on a signal matrix obtained from scanning a station in the spectral band tentatively determining that the station represents a digital radio mondiale (DRM) station and storing an identification of the station in a list of possible DRM stations in the memory, wherein the list of possible DRM stations includes DRM stations and band pass noise identified as tentative DRM stations.

2. The radio receiver of claim 1, wherein the analog tuner is an amplitude modulation (AM) tuner.

3. The radio receiver of claim 2, wherein the tentatively determining includes measuring if a carrier frequency offset is greater than 2 KHz.

4. The radio receiver of claim 2, wherein the tentatively determining includes measuring if a dominant frequency is greater than 5 KHz.

5. The radio receiver of claim 2, wherein the tentatively determining includes measuring if a high modulation index is unsettled.

6. The radio receiver of claim 1, wherein the analog tuner is a frequency modulation (FM) tuner.

7. The radio receiver of claim 6, wherein the tentatively determining includes measuring if a level detector result is an unsettled value.

8. The radio receiver of claim 6, wherein the tentatively determining includes measuring if a multipath detector result is an unsettled value.

9. The radio receiver of claim 6, wherein the tentatively determining includes measuring if a radio frequency offset is an arbitrary value.

10. The radio receiver of claim 1, wherein the controller is further configured to scan stations in the list of possible DRM stations to remove stations that represent band pass noise.

11. The radio receiver of claim 1, wherein the controller is further configured to identify AM or FM stations during the scanning for tentative DRM stations.

12. A method for tentatively identifying digital radio mondiale (DRM) stations in a spectral band using an analog tuner, the method comprises:

scanning a station in a spectral band using the analog tuner;

based on a signal matrix obtained from the station in the spectral band tentatively determining that the station represents a digital radio mondiale (DRM) station and storing an identification of the station in a list of possible DRM stations in a memory, wherein the list of possible DRM stations includes DRM stations and band pass noise identified as tentative DRM stations.

13. The method of claim 12, wherein the analog tuner is an amplitude modulation (AM) tuner.

14. The method of claim 13, wherein the tentatively determining includes measuring if a carrier frequency offset is greater than 2 KHz.

15. The method of claim 13, wherein the tentatively determining includes measuring if a dominant frequency is greater than 5 KHz.

16. The method of claim 13, wherein the tentatively determining includes measuring if a high modulation index is unsettled.

17. The method of claim 12, wherein the analog tuner is a frequency modulation (FM) tuner.

18. The method of claim 17, wherein the tentatively determining includes measuring if a level detector result is an unsettled value.

* * * * *